US007137681B2

(12) United States Patent
Fujimori et al.

(10) Patent No.: US 7,137,681 B2
(45) Date of Patent: Nov. 21, 2006

(54) PRINTING COMPENSATING FOR JETTING AMOUNT FOR EACH OF MULTIPLE TYPES OF INK DROPS WITH DIFFERENT SIZES

(75) Inventors: Yukimitsu Fujimori, Nagano-ken (JP); Takashi Maruyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 189 days.

(21) Appl. No.: 10/475,048

(22) PCT Filed: Dec. 11, 2002

(86) PCT No.: PCT/JP02/12987

§ 371 (c)(1),
(2), (4) Date: Oct. 17, 2003

(87) PCT Pub. No.: WO03/051636

PCT Pub. Date: Jun. 26, 2003

(65) Prior Publication Data

US 2004/0119765 A1 Jun. 24, 2004

(30) Foreign Application Priority Data

Dec. 18, 2001 (JP) ..... 2001-384968

(51) Int. Cl.
*B41J 2/205* (2006.01)

(52) U.S. Cl. ..... 347/15; 358/1.9

(58) Field of Classification Search ..... 347/5, 347/7, 9, 43, 84, 85, 94, 95, 131, 15; 358/3.03, 358/3.13, 534, 3.06, 1.9
See application file for complete search history.

(56) References Cited

U.S. PATENT DOCUMENTS 6,042,211 A 3/2000 Hudson et al.
6,799,824 B1 * 10/2004 Nunokawa ..... 347/15
6,943,918 B1 * 9/2005 Kakutani ..... 358/3.02
2002/0140748 A1 * 10/2002 Kanaya et al. ..... 347/7

FOREIGN PATENT DOCUMENTS

| | | |
|---|---|---|
| JP | 04-028561 | 1/1992 |
| JP | 06-320796 | 11/1994 |
| JP | 07-242004 | 9/1995 |
| JP | 10-138509 | 5/1998 |
| JP | 11-099672 | 4/1999 |
| JP | 2000-198202 | 7/2000 |
| JP | 2001-001570 | 1/2001 |
| JP | 2001-158085 | 6/2001 |
| JP | 2001-158116 | 6/2001 |

OTHER PUBLICATIONS

Abstract of Japanese Patent Publication No. 11-099672, Pub. Date: Apr. 13, 1999, Patent Abstracts of Japan.
Abstract of Japanese Patent Publication No. 04-028561 Pub. Date: Jan. 31, 1992, Patent Abstracts of Japan.
Abstract of Japanese Patent Publication No. 06-320796, Pub. Date: Nov. 22, 1994, Patent Abstracts of Japan.

(Continued)

*Primary Examiner*—Stephen Meier
*Assistant Examiner*—Rene Garcia, Jr.
(74) *Attorney, Agent, or Firm*—Martine Penilla & Gencarella, LLP

(57) ABSTRACT

According to the present invention, for at least one specific type of ink drop from among a plurality of types of ink drops of different quantities of ink, dot data can be generated in such a way as to compensate for error of ink amount for each specific type of ink drop with reference to information representing error of ink amount for given specific type of ink drops. By means of this, even if there is deviation in error of ink amount for each of different types of ink drops, color can be reproduced more accurately.

8 Claims, 14 Drawing Sheets

OTHER PUBLICATIONS

Abstract of Japanese Patent Publication No. 07-242004, Pub. Date: Sep. 19, 1995, Patent Abstracts of Japan.
Abstract of Japanese Patent Publication No. 10-138509, Pub. Date: May 26, 1998, Patent Abstracts of Japan.
Abstract of Japanese Patent Publication No. 2000-198202, Pub. Date: Jul. 18, 2000, Patent Abstracts of Japan.
Abstract of Japanese Patent Publication No. 2001-001570, Pub. Date: Jan. 9, 2001, Patent Abstracts of Japan.
Abstract of Japanese Patent Publication No. 2001-158085, Pub. Date: Jun. 12, 2001, Patent Abstracts of Japan.
Abstract of Japanese Patent Publication No. 2001-158166, Pub. Date: Jun. 12, 2001, Patent Abstracts of Japan.

* cited by examiner

Fig.9

TM

| | | | |
|---|---|---|---|
| 1 | 9 | 3 | 11 |
| 13 | 5 | 15 | 7 |
| 4 | 12 | 2 | 10 |
| 16 | 8 | 14 | 6 |

UM

| | | | |
|---|---|---|---|
| 16 | 8 | 14 | 6 |
| 4 | 12 | 2 | 10 |
| 13 | 5 | 15 | 7 |
| 1 | 9 | 3 | 11 |

The First Embodiment (a)

(b)

Ink Amount of Ink Drops for Forming Dots of Each Size

| Type of Dot | Target Value | Error Information | Estimated Value | Compensation Coefficient | After Compensation |
|---|---|---|---|---|---|
| Small Dot | 10ng | 0.1 | 11ng | 0.91 | 10 |
| Medium Dot | 20ng | −0.15 | 17ng | 1.18 | 20.1 |
| Large Dot | 30ng | 0.2 | 36ng | 0.83 | 29.9 |

The Second Embodiment (a)

(b)

$$Gc = \frac{Rt}{Re} \times G$$

The Third Embodiment

Fig.15

(a)Relationship between input tone value and ink amount for forming dots of each size (Theoretical)

| Input Tone value | 0 | 1 | 2 | 3 | 4 | … | 104 | 105 | 106 | 107 | 108 | 109 | 110 | 111 | 112 | 113 | 114 | 115 | … | 253 | 254 | 255 |
|---|---|---|---|---|---|---|---|---|---|---|---|---|---|---|---|---|---|---|---|---|---|---|
| Number of Small Dot | 0 | 3 | 6 | 9 | 12 | … | 64 | 64 | 64 | 64 | 64 | 64 | 64 | 64 | 64 | 64 | 64 | 64 | … | 1 | 0 | 0 |
| Number of Medium Dot | 0 | 0 | 0 | 0 | 0 | … | 125 | 127 | 128 | 128 | 128 | 128 | 128 | 128 | 128 | 128 | 128 | 128 | … | 2 | 1 | 0 |
| Number of Large Dot | 0 | 0 | 0 | 0 | 0 | … | 0 | 0 | 0 | 1 | 2 | 3 | 4 | 5 | 6 | 7 | 8 | 9 | … | 251 | 253 | 255 |
| Ink Amount for Small Dot | 0 | 30 | 60 | 90 | 120 | … | 640 | 640 | 640 | 640 | 640 | 640 | 640 | 640 | 640 | 640 | 640 | 640 | … | 10 | 0 | 0 |
| Ink Amount for Medium Dot | 0 | 0 | 0 | 0 | 0 | … | 2500 | 2540 | 2560 | 2560 | 2560 | 2560 | 2560 | 2560 | 2560 | 2560 | 2560 | 2560 | … | 40 | 20 | 0 |
| Ink Amount for Large Dot | 0 | 0 | 0 | 0 | 0 | … | 0 | 0 | 0 | 30 | 60 | 90 | 120 | 150 | 180 | 210 | 240 | 270 | … | 7530 | 7590 | 7650 |
| Theoretical Ink Amount | 0 | 30 | 60 | 90 | 120 | … | 3140 | 3180 | 3200 | 3230 | 3260 | 3290 | 3320 | 3350 | 3380 | 3410 | 3440 | 3470 | … | 7580 | 7610 | 7650 |

Target Values of Ink Amount
Ink Drop for forming Small Dot: 10 ng
Ink Drop for forming Medium Dot: 20 ng
Ink Drop for forming Large Dot: 30 ng Unit
Dot : ea.
Ink Amount : ng (b)Relationship between input tone value and ink amount for forming dots of each size (Estimated)

| Output Tone value | 0 | 1 | 2 | 3 | 4 | … | 104 | 105 | 106 | 107 | 108 | 109 | 110 | 111 | 112 | 113 | 114 | 115 | … | 222 | 222 | 255 |
|---|---|---|---|---|---|---|---|---|---|---|---|---|---|---|---|---|---|---|---|---|---|---|
| Number of Small Dot | 0 | 3 | 6 | 9 | 12 | … | 64 | 64 | 64 | 64 | 64 | 64 | 64 | 64 | 64 | 64 | 64 | 64 | … | 1 | 0 | 0 |
| Number of Medium Dot | 0 | 0 | 0 | 0 | 0 | … | 125 | 127 | 128 | 128 | 128 | 128 | 128 | 128 | 128 | 128 | 128 | 128 | … | 2 | 1 | 0 |
| Number of Large Dot | 0 | 0 | 0 | 0 | 0 | … | 0 | 0 | 0 | 1 | 2 | 3 | 4 | 5 | 6 | 7 | 8 | 9 | … | 251 | 253 | 255 |
| Ink Amount for Small Dot | 0 | 33 | 66 | 99 | 132 | … | 704 | 704 | 704 | 704 | 704 | 704 | 704 | 704 | 704 | 704 | 704 | 704 | … | 11 | 0 | 0 |
| Ink Amount for Medium Dot | 0 | 0 | 0 | 0 | 0 | … | 2125 | 2159 | 2176 | 2176 | 2176 | 2176 | 2176 | 2176 | 2176 | 2176 | 2176 | 2176 | … | 34 | 17 | 0 |
| Ink Amount for Large Dot | 0 | 0 | 0 | 0 | 0 | … | 0 | 0 | 0 | 36 | 72 | 108 | 144 | 180 | 216 | 252 | 288 | 324 | … | 9036 | 9108 | 9180 |
| Estimated Ink Amount | 0 | 33 | 66 | 99 | 132 | … | 2829 | 2863 | 2880 | 2916 | 2952 | 2988 | 3024 | 3060 | 3096 | 3132 | 3168 | 3204 | … | 9081 | 9125 | 9180 |

Error Information
Ink Drop for forming Small Dot: +10% (11 ng)
Ink Drop for forming Medium Dot: −15% (17 ng)
Ink Drop for forming Large Dot: +20% (36 ng)

Unit
Dot : ea.
Ink Amount : ng

Fig.16

| Input Tone value | 0 | 1 | 2 | 3 | 4 | … | 104 | 105 | 106 | 107 | 108 | 109 | 110 | 111 | 112 | 113 | 114 | 115 | … | 253 | 254 | 255 |
|---|---|---|---|---|---|---|---|---|---|---|---|---|---|---|---|---|---|---|---|---|---|---|
| Theoretical Ink Amount | 0 | 30 | 60 | 90 | 120 | … | 3140 | 3180 | 3200 | 3230 | 3260 | 3290 | 3320 | 3350 | 3380 | 3410 | 3440 | 3470 | … | 7590 | 7620 | 7650 |
| Output Tone value | 0 | 1 | 2 | 3 | 4 | … | 113 | 114 | 115 | 116 | 117 | 117 | 118 | 119 | 120 | 121 | 121 | 122 | … | 222 | 222 | 255 |
| Estimated Ink Amount | 0 | 33 | 66 | 99 | 132 | … | 3132 | 3168 | 3204 | 3240 | 3276 | 3276 | 3312 | 3348 | 3384 | 3420 | 3420 | 3456 | … | 7596 | 7596 | 9180 |

Ink Amount : ng

PRINTING COMPENSATING FOR JETTING AMOUNT FOR EACH OF MULTIPLE TYPES OF INK DROPS WITH DIFFERENT SIZES

TECHNICAL FIELD

1. Field of the Invention

This invention relates to a technique for printing images on a print medium by ejecting ink thereon.

2. Background Art

In recent years, color printers of a type that ejects inks of several colors from a print head have come to enjoy widespread use as computer output devices, and are widely used for multi-color, multi-tone printing of computer-processed images. To achieve high image quality in such printers, it is necessary to accurately reproduce tone values for each color.

To accurately reproduce tone values for each color, it is required to make the ink amount ejected per unit of area accurate. To meet this requirement, it has been proposed, for example, in JP 11-99672A disclosed by the Applicant, to compensate for individual print head errors in ink ejection amount due to print head manufacture error.

However, with a method of compensating for errors in ink ejection amount for individual print heads, in the event that error differs among several kind of ink drops in different size formed by a given print head, it was not possible to compensate for errors in ink amount in a detailed manner with respect to each of ink drops in different kind.

DISCLOSURE OF THE INVENTION

Accordingly, an object of the present invention is to provide a technique for compensating for the ink amount error of ink drops in different size in order to improve reproducibility of the color.

In order to attain the above and the other objects of the present invention, there is provided a printing control apparatus for generating print data to be supplied to a print unit capable of forming one of N types of dots having different sizes at one pixel area by a selective ejection of any of the N types of ink drops onto a print medium. The N types of ink drops are different in an ink amount. N is an integer of at least 2. The apparatus comprises an error information receiver and a dot data generator. The error information receiver is configured to receive error information indicative of an ink amount error of at least one specific type of ink drop among the N types of ink drops. The dot data generator is configured to process input image data for generating dot data representing a state of dot formation at each pixel in a printed image. The dot data generator is configured to generate the dot data compensated for the ink amount error with respect to each of the specific type of ink drops in response to the error information data.

According to the present invention, for at least one specific type of ink drops from among a plurality of types of ink drops of different amounts of ink, dot data can be generated in such a way as to compensate for error of ink amount for each of the specific types of ink drops, so even if there is deviation in error of ink amount for each of the specific types of ink drops, color can be reproduced more accurately.

In a preferred embodiment of the invention, the dot data generator comprises a color converter and a halftone processor. The color converter is configured to convert a color system of the input image data with a color conversion table for generating color-converted image data. The color-converted image data is represented with a plurality of color components available for the print unit. The halftone processor is configured to convert a tone value of the color-converted image data to any of the N tones with respect to each pixel based on a compensated relationship between an input and an output. The input is the tone value of the color-converted image data. The output is a combination of dot recording rates for each of the N dots. The compensated relationship is compensated with the error information. The halftone processor is configured to generate the compensated relationship using a reference relationship and the error information. The reference relationship is a relationship between the combination of dot recording rates for each of the N dots and a provided tone value of the color-converted image data assuming no ink amount error.

By so doing, ink amount can be compensated by means of compensating a correspondence relationship having tone values of color-converted image data as input and a combination of recording rates for each of N types of dots as output, so a combination of recording rates for each of N types of dots prepared in advance on the assumption that there is no error of ink amount can be used as is to perform halftone processing. As a result, even where a combination of dot recording rates has been set so as to minimize graininess (deviation of image) and banding (band-like image degradation), the features of the combination of dot recording rates will not be excessively diminished, and color can be reproduced more accurately.

In a preferred embodiment of the invention, the halftone processor is configured to calculate a first ink amount and a second ink amount with respect to each of the tone values of the color-converted image data based on the reference relationship, and also to multiply a value of the first ink amount divided by the second ink amount for generating the compensated relationship. The first ink amount is an ink amount ejected per unit of area excluding the ink amount error. The second ink amount is an ink amount ejected per unit of area including the ink amount error. By so doing, a corrected correspondence relationship can be determined quickly by means of a simple arrangement.

In a preferred embodiment of the invention, the halftone processor is configured to calculate a first ink amount with respect to each of the tone values of the color-converted image data based on the reference relationship, and also to adjust the reference relationship for a second ink amount to approximate to the first ink amount. The first ink amount is an ink amount ejected per unit of area excluding the ink amount error. The second ink amount is an ink amount ejected per unit of area including the ink amount error. By so doing, a corrected correspondence relationship can be generated more accurately.

In a preferred embodiment of the invention, the dot data generator comprises a color converter and a halftone processor. The color converter is configured to convert a color system of the input image data with a compensated color conversion table for generating color-converted image data. The color-converted image data is represented with a plurality of color components available for the print unit. The compensated color conversion table is compensated with the error information. The halftone processor configured to convert a tone value of the color-converted image data to any of the N tones with respect to each pixel based on a relationship between an input and an output. The input is the tone value of the color-converted image data. The output is a combination of dot recording rates for each of the N dots. The color converter is configured to generate the compensated color conversion table using a reference color conversion table and the error information. The reference color conversion table is set assuming no ink amount error.

Even if ink amount error is compensated in color conversion processing of this kind, tone values can be represented using a preset combination of dot recording rates, so the features of the combination of dot recording rates will not be excessively diminished, and color can be reproduced more accurately.

The present invention can be realized in various forms such as a method and apparatus for printing, a method and apparatus for producing print data for a printing unit, and a computer program product implementing the above scheme.

BRIEF DESCRIPTION OF THE DRAWINGS

FIG. 9 is an explanatory diagram showing the relationship of a dither matrix used in large dot determination and a dither matrix used in medium dot determination.

FIGS. 15(*a*) and 15(*b*) are explanatory diagrams showing dot recording rate table DT and ink ejection amount in the third embodiment of the present invention.

FIG. 16 is a correspondence chart used for adjusting tone value in the third embodiment.

DESCRIPTION OF THE PREFERRED EMBODIMENTS

Embodiments of the present invention will now be described through embodiments in the following sequence.

A. Apparatus Structure:

B. Dot Formation Control Process

C. Ink Amount Compensation in the first embodiment

D. Ink Amount Compensation in the second embodiment

E. Ink Amount Compensation in the third embodiment

F. Variations

Figure 1:
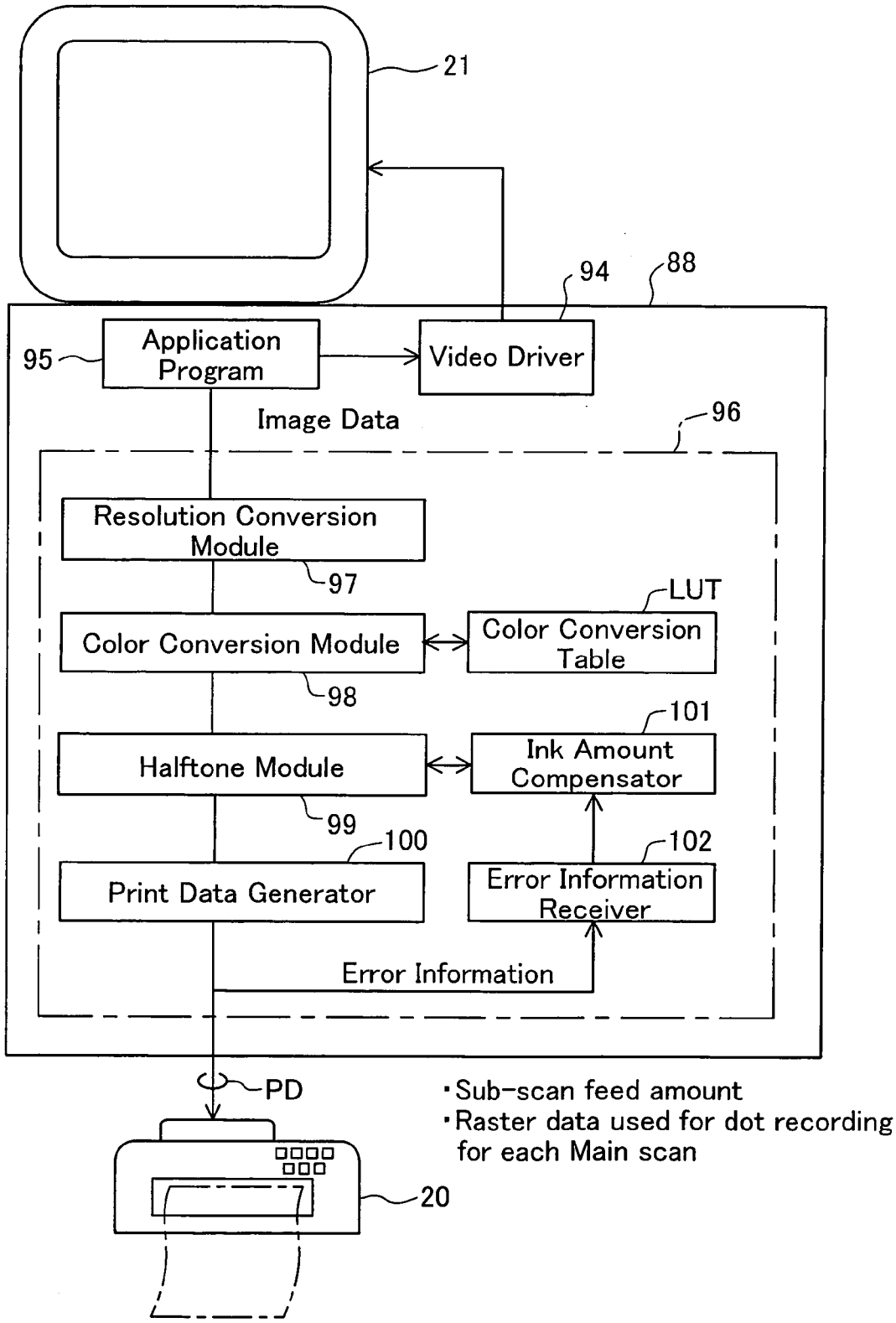
FIG. 1 is a block diagram that shows the structure of a printing system as an embodiment of the present invention.

A. Apparatus Structure:

FIG. 1 is a block diagram that shows the structure of a printing system as an embodiment of the present invention. This printing system has a computer 88 as a printing control apparatus, and a color printer 20 as a print unit. The combination of color printer 20 and computer 88 can be called a "printing apparatus" in its broad definition.

Application program 95 operates on computer 88 under a specific operating system. Video driver 94 and printer driver 96 are incorporated in the operating system, and print data PD to be sent to color printer 20 is output via these drivers from application program 95. Application program 95 performs the desired processing on the image to be processed, and displays the image on CRT 21 with the aid of video driver 94.

When application program 95 issues a print command, printer driver 96 of computer 88 receives image data from application program 95, and converts this to print data PD to supply to color printer 20. In the embodiment shown in FIG. 1, printer driver 96 includes resolution conversion module 97, color conversion module 98, Halftone module 99, print data generator 100, color conversion table LUT, ink amount compensator 101, and error information receiver 102. The functions performed by these will be described below.

Printer driver 96 is a program for realizing a function that generates print data PD. A program for realizing the functions of printer driver 96 is supplied in a format recorded on a recording medium that can be read by a computer. As this kind of recording medium, any variety of computer readable medium can be used, including floppy disks, CD-ROMs, opt-magnetic disks, IC cards, ROM cartridges, punch cards, printed items on which a code such a bar code is printed, a computer internal memory device (memory such as RAM or ROM), or external memory device, etc.

Figure 2:
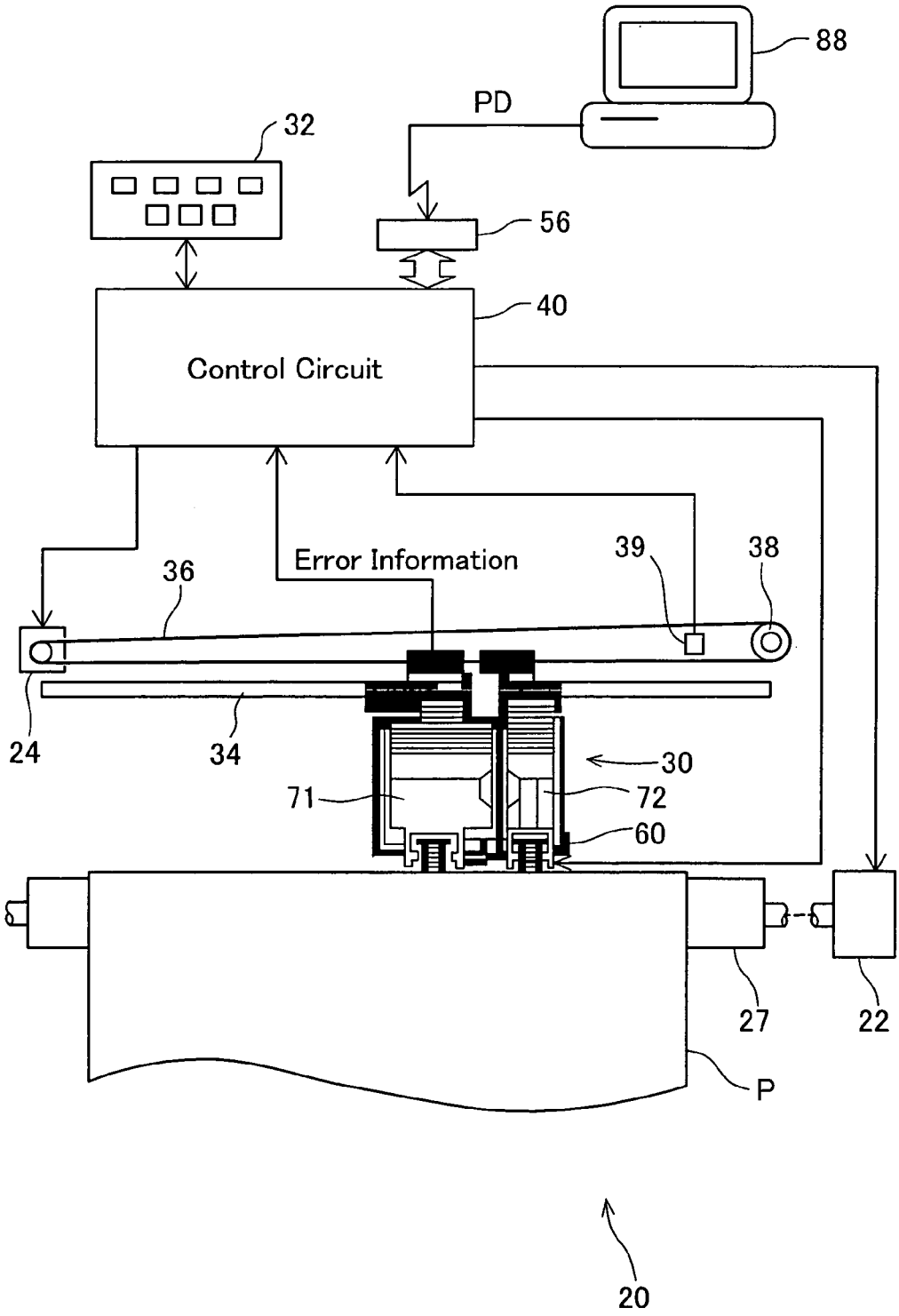
FIG. 2 is a schematic structural diagram of color printer 20.

FIG. 2 is a schematic structural diagram of color printer 20. Color printer 20 is equipped with a sub-scan feed mechanism that carries printing paper P in the sub-scanning direction using paper feed motor 22, a main scan feed mechanism that sends cartridge 30 back and forth in the axial direction of sub-scan feed mechanism 27 using carriage motor 24, a head driving mechanism that drives print head unit 60 built into carriage 30 and controls ink ejecting and dot formation, and control circuit 40 that controls the interaction between the signals of paper feed motor 22, carriage motor 24, print head unit 60, and operating panel 32. Control circuit 40 is connected to computer 88 via connector 56.

Print head unit 60 has a memory, not shown, that stores error information indicating ink ejection amount error. Control circuit 40 reads out error information from this memory, and transmits it to computer 88 via connector 56. The transmitted error information is received by error information receiver 102 (FIG. 1) in computer 88.

The sub-scan feed mechanism for transporting printer paper P comprises a gear train (omitted from the drawing) that transfers rotation of paper feed motor 22 to sub-scan feed mechanism 27 and a paper transport roller (not shown). The main scan feed mechanism for reciprocating carriage 30 comprises a slide rail 34 extending perpendicular to axis of sub-scan feed mechanism 27, for slidably retaining carriage 30; a pulley 38 around which is passed an endless belt 36 that extends between it and the carriage motor 24; and a position sensor 39 for sensing the home position of carriage 30.

Figure 3:
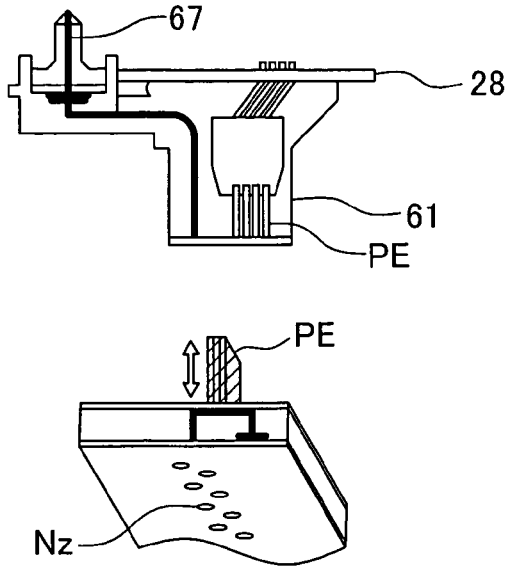
FIG. 3 is an explanatory diagram showing a simplified arrangement inside the print head 28.

FIG. 3 is an explanatory diagram showing a simplified arrangement inside the print head 28. When ink cartridges 71, 72 (FIG. 2) are installed on carriage 30, the ink inside the ink cartridges is drawn out through an introduction line 67 and introduced into color heads 61 for each color in the print head 28 provided below carriage 30. When an ink cartridge is initially installed, an operation to suction the ink from color heads is performed by a dedicated pump, but in this embodiment the pump for suctioning, the cap covering the print head 28 during suctioning, and other such arrangements are neither shown in the drawings nor described.

Figure 4:
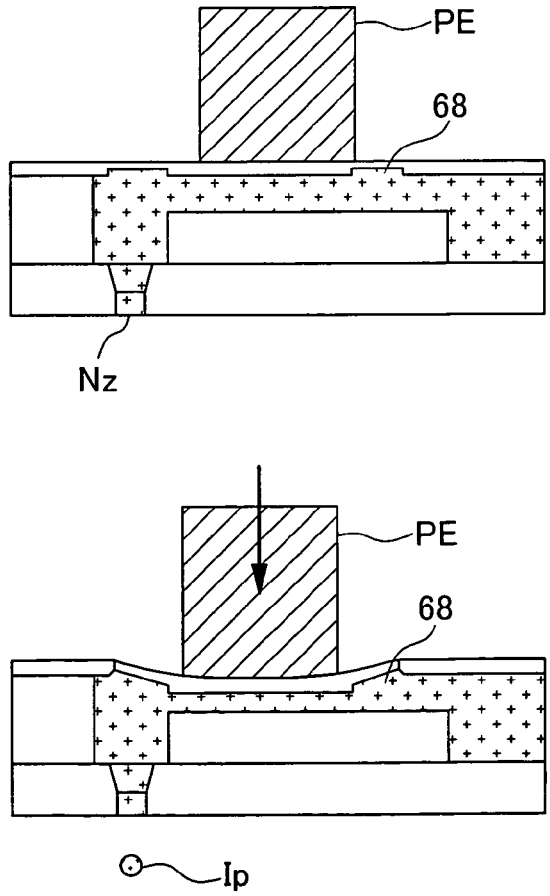
FIG. 4 is an explanatory diagram illustrating the principle of dot formation in a printer in an embodiment of the present invention.

Color heads 61 are provided with a plurality of nozzles Nz for each color, and a piezo element PE which is one kind of electrostriction device and has excellent response is installed for each nozzle. Details of the structure of a piezo element PE and a nozzle Nz are shown in FIG. 4. As shown in the upper portion of FIG. 4, piezo element PE is installed at a location contacting ink passage 68 which introduces ink to nozzle Nz. Piezo element PE is an element that undergoes deformation of its crystal structure through application of electrical voltage, and performs electrical-mechanical energy conversion extremely rapidly.

In this embodiment, by applying electrical voltage for a predetermined time interval across electrodes provided to either end of piezo element PE, the piezo element PE expands for the time interval that electrical voltage is applied, and deforms one side wall of ink passage 68 as shown in the bottom portion of FIG. 4. As a result, the volume of ink passage 68 constricts in response to expansion of piezo element PE, and ink corresponding to this volume forms an ink drop Ip, which is rapidly ejected from the tip of nozzle Nz. This ink drop Ip penetrates into the paper P installed on the sub-scan feed mechanism 27 to perform printing. This size of ink drop Ip can be modified by means of the method of applying voltage to piezo element PE. By means of this, it is possible to form, for example, dots of three sizes, large, medium, and small.

The size of ink drop Ip can vary due to manufacturing error of ink passage 68 and individual differences among piezo elements PE as well. The amount of this variation is stored as error information in memory provided to print head unit 60. Error information is information for each ink drop Ip for forming each dot of large, medium, or small size. The example described later has the object of compensating this variation amount for each type of ink drop Ip to perform correct color reproduction.

Printer 20 having the hardware arrangement described hereinabove transports paper P by means of paper feed motor 22 (hereinafter termed "sub-scanning") while reciprocating carriage 30 by means of carriage motor 24 (hereinafter termed "main scanning"), and at the same time driving the piezo elements PE of color heads 61 of print head 28 to perform ejection of each color ink, to form dots and form a multicolor image on paper P.

B. Dot Formation Control Process

Figure 5:
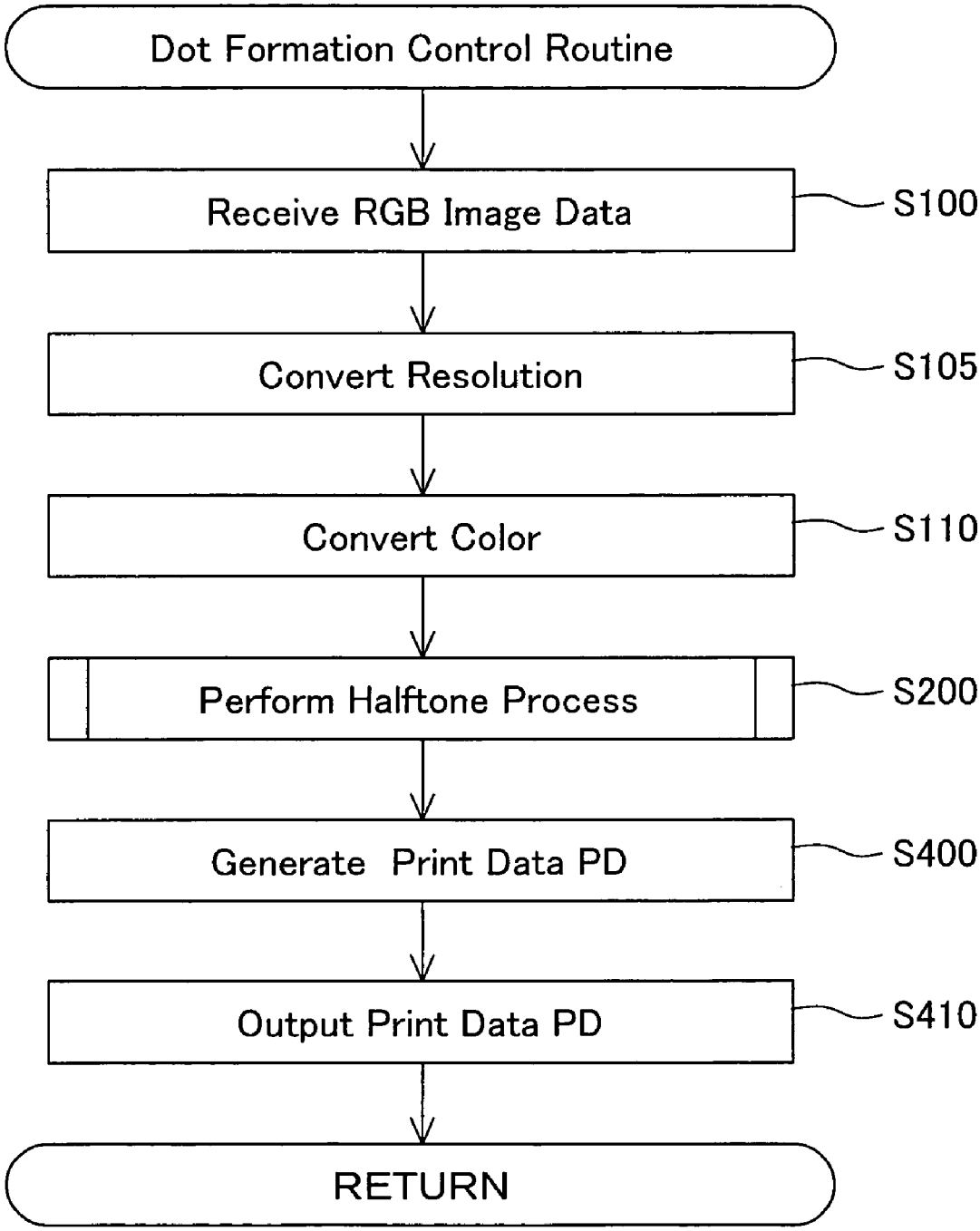
FIG. 5 is a flow chart showing the flow of a dot formation control routine.

FIG. 5 is a flow chart showing the flow of the dot formation control routine in this embodiment. This process is executed in computer 88. In Step S100, printer driver 96 receives RGB image data. This image data is data transferred from application program 95 shown in FIG. 1, and is date having tone values for 256 tone values of values 0–255 for each of the colors R, G, B for each pixel that makes up the image.

In Step S105, resolution conversion module 97 converts the resolution of the input image data to the resolution in the printer 20. In the event that image data is lower than the print resolution, resolution conversion is performed by generating new data between adjacent original image data by means of linear interpolation. Conversely, the event that image data is higher than the print resolution, resolution conversion is performed by thinning out data at a predetermined rate.

In Step S110, color conversion module 98 performs a color conversion process. The color conversion process is a process for converting image data consisting of R, G, B tone values into multi-tone data representing tone values for each of the colors C, M, Y, K used by printer 20. This process is performed using a color conversion table LUT (see FIG. 1) which stores C, M, Y, K combinations for representing by means of printer 20 colors consisting of R, G, B combinations. This multi-tone data corresponds to the color-converted image data in the Claims.

In Step S200, halftone module 99 performs a halftone process on the image data that has been color converted in this way. Halftone process refers to a decrease process to decrease tone values of the original image data (in this embodiment, 256 tone values) to a number of tone values that can represented in each pixel by printer 20. Here, "decrease process" refers to reducing the number of tone values representing colors. In this embodiment, decrease to four tone values, namely, "no dot formation", "small dot formation", "medium dot formation", and "large dot formation", is performed.

Figure 6:
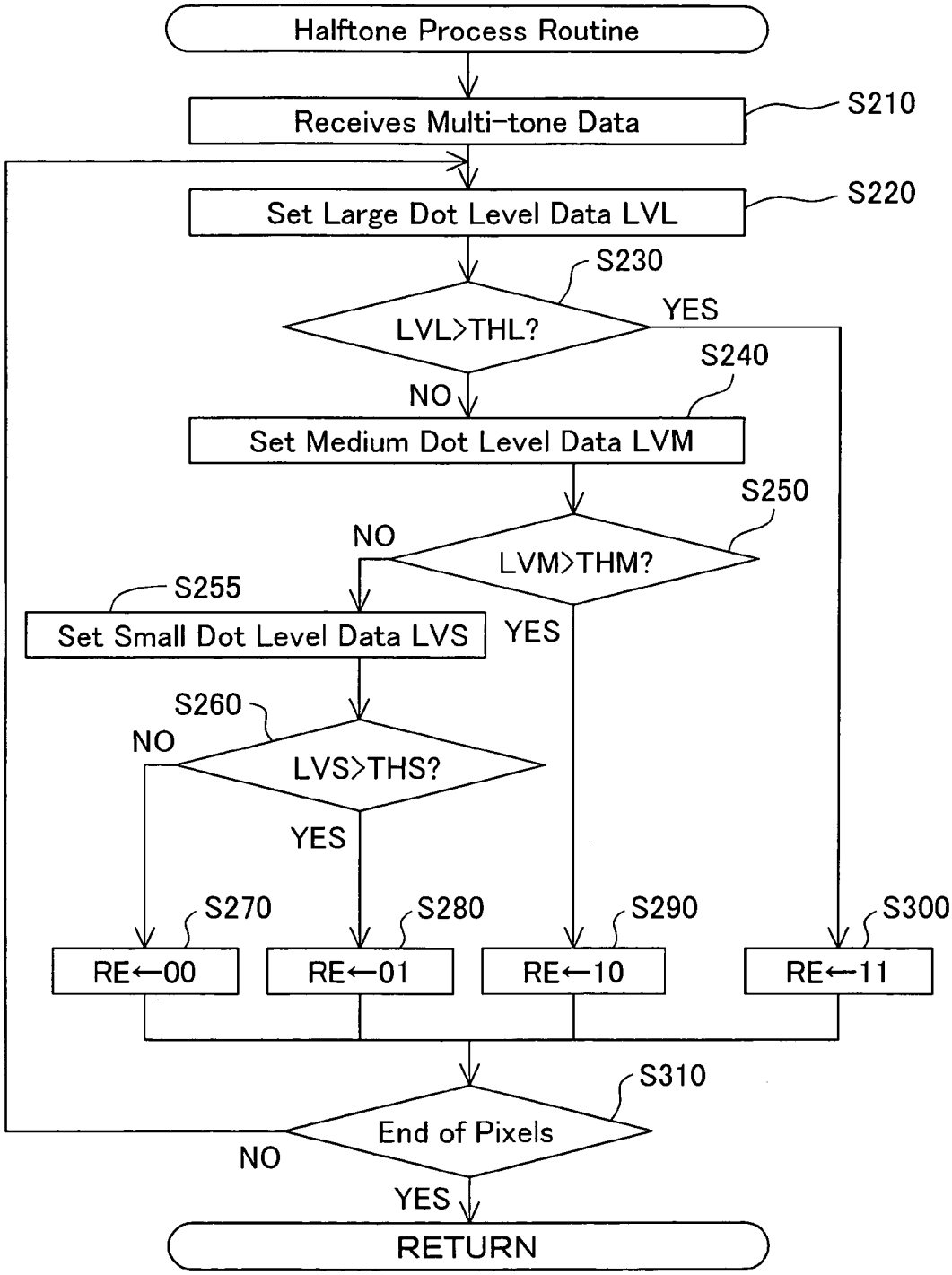
FIG. 6 is a flow chart showing the flow of the halftone process in the present embodiment.

FIG. 6 is a flow chart showing the flow of the halftone process in the present embodiment. In Step S210, halftone module 99 receives multi-tone data from color conversion module 98. The multi-tone data input here is data that has been subjected to the color conversion process (Step S110 in FIG. 5) and that has 256 tone values for each of the colors C, M, Y, K. In Step S220, large dot level data LVL is determined in the following manner with reference to tone values of this image data.

Figure 7:
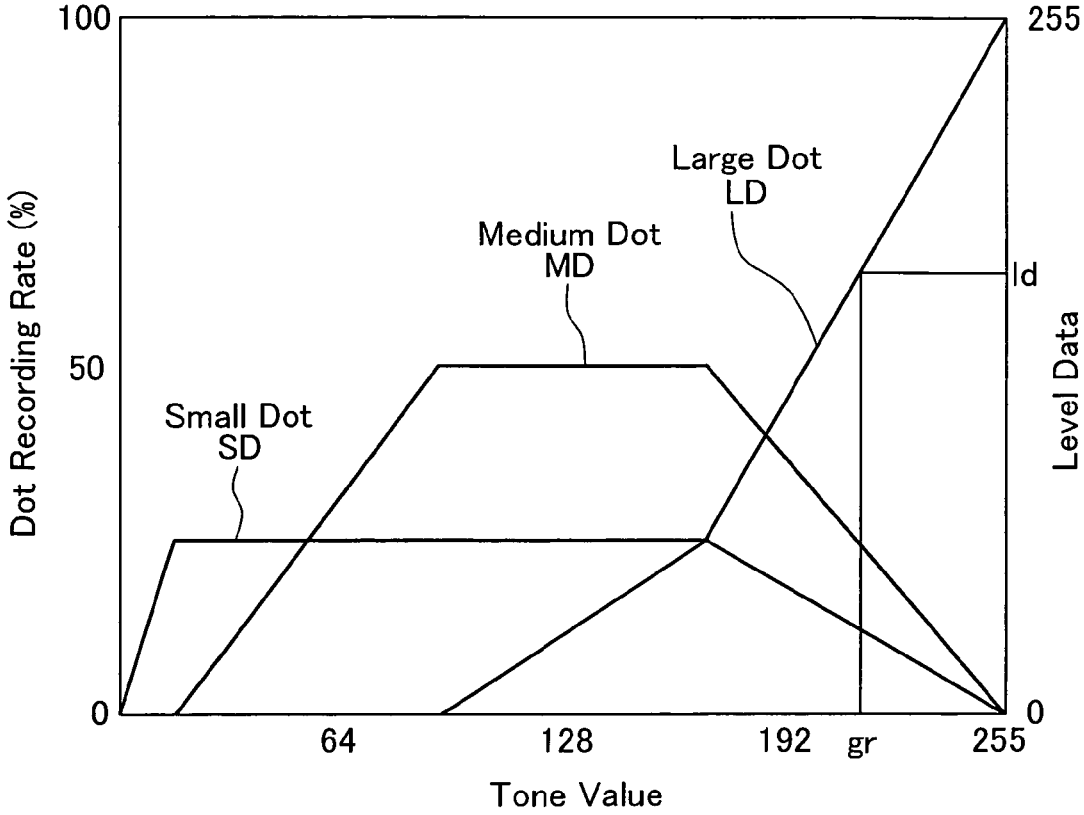
FIG. 7 is an explanatory diagram showing a dot recording rate table used to determine level data for large, medium, and small dots.

FIG. 7 is an explanatory diagram showing a dot recording rate table used to determine level data for large, medium, and small dots. The horizontal axis in FIG. 7 is tone value (0–255), the left hand vertical axis is dot recording rate (%), and the right hand vertical axis is level data (0–255). Here, for a uniform area reproduced according to a given tone value, "dot recording rate" means the proportion of pixels on which dots are formed, among the pixels in that area. Curve DS in FIG. 7 shows the small dot recording rate, curve MD shows the medium dot recording rate, and curve LD. shows the large dot recording rate, respectively. Level data refers to data in which dot recording rate has been converted to 256 tone values with values of 0–255.

In Step S220, level data LVL corresponding to tone value is read out from the large dot curve LD. For example, as shown in FIG. 7, if tone value of multi-tone data is gr, level data LVL is calculated as Id using curve LD. In actual practice, curve LD is stored in memory as a one-dimensional table, not shown, and level data is calculated making reference to this table. In this Description, this table is called recording rate table DT.

In Step S230, a determination is made as to whether level data LVL set in this way is greater than a threshold value THL. Here, dot on/off determination is performed by means of a dither method, for example. Threshold values THL are different values set for each pixel using a so-called dither matrix. In this embodiment, a matrix representing values of 0–254 in a 16×16 square pixel block is used.

Figure 8:
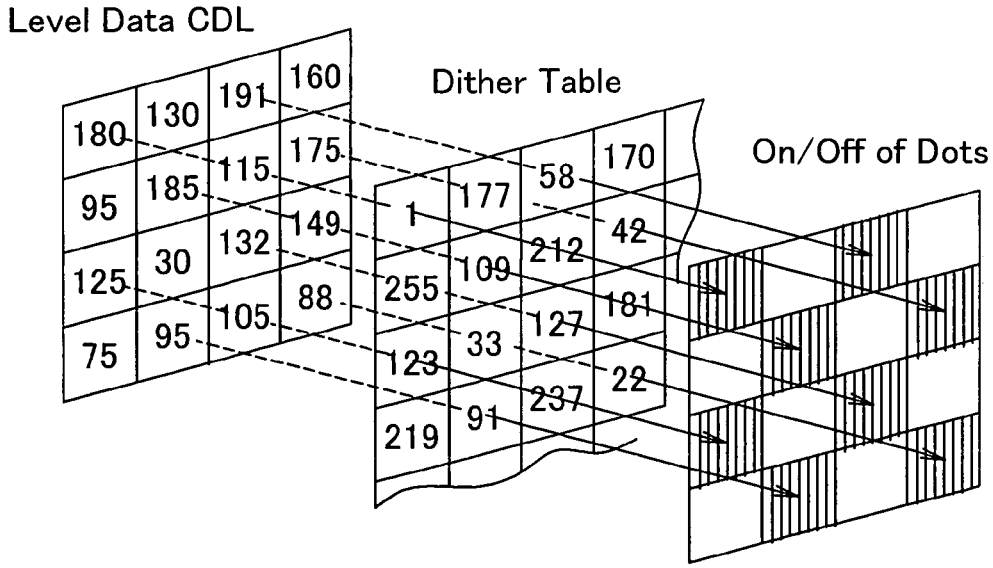
FIG. 8 is an explanatory diagram showing the concept of dot ON/OFF determination by a dither method.

FIG. 8 is an explanatory diagram showing the concept of dot ON/OFF determination by a dither method. For convenience in illustration, only a portion of the pixels are shown. As shown in FIG. 8, each pixel of level data LVL is compared with magnitude of the corresponding location in the dither table. Where level data LVL is greater than threshold value THL, a dot is made ON, and where level data LVL is smaller than threshold value THL, a dot is made OFF. Pixels shown hatched in FIG. 8 means pixels in which dots are made ON.

Where level data LVL is greater than threshold value THL, halftone module 99 determines that a large dot should be made ON, and substitutes a variable RE indicating the result value with a binary value 11 (Step S300). Result value RE is a variable representing the size of the dot to be formed on a pixel. Where this variable is 11, a large dot will be formed.

On the other hand, in Step S230, if level data LVL is smaller than threshold value THL, halftone module 99 determines that a large dot should not be formed, and proceeds to Step S240. In Step S240, medium dot level data LVM is set. Medium dot level data LVM is set on the basis of tone value, by means of the recording rate table DT described previously. The setting method is the same as for large dot level data LVL.

In Step S250, the relative magnitude of medium dot level data LVM and threshold value THM are compared, and medium dot ON/OFF determination is performed. The method of ON/OFF determination is the same as in the case of large dots, but the threshold value LVM used for the determination is a different value from the threshold value LVL in the case of large dots, as indicated below.

Where ON/OFF determination for both large dots and medium dots is performed using the same dither matrix, pixels in which dots easily go ON coincide between the two. That is, when a large dot goes OFF, there is a high likelihood that a medium dot will go OFF as well. As a result, there is a possibility that the medium dot recording rate will be lower than the desired recording rate. In this embodiment, in order to avoid such a phenomenon, the dither matrix is changed between the two. That is, by changing locations of pixels that easily go ON between large dots and medium dots, appropriate formation in each is assured.

FIG. 9 is an explanatory diagram showing the relationship of a dither matrix used in large dot determination and a dither matrix used in medium dot determination. In this embodiment, as shown in the drawing, a first dither matrix TM is used for large dots, and a second dither matrix UM, in which threshold values have been shifted symmetrically in the sub-scanning direction, is used for medium dots. In this embodiment, as mentioned previously, 64×64 matrices are used, but for convenience in illustration only 4×4 matrices are shown in FIG. 9. Dither matrices that are completely different from each other may be used for large dots and medium dots.

In Step S250, in the event that level data LVM of a medium dot is greater than threshold value THM, a determination is made that a medium dot should go ON, and a binary value 10 is substituted in result value RE (Step S290). On the other hand, in Step S250 if level data LVM of a medium dot is smaller than threshold value THM, a determination is made that a medium dot should not be formed, and proceeds to Step S255.

In Step S255, small dot level data LVS is set in the same manner as setting of level data for large dots and medium dots. In Step S260, halftone module 99, in the event that level data LVS is greater than threshold value THS, makes a determination that a small dot should go ON, and substitutes a binary value 01 in result value RE (Step S280). On the other hand, in Step S260, if level data LVS of a small dot is smaller than threshold value THS, a determination that no dot should be formed is made, and a binary value 00 is substituted in result value RE (Step S270). In preferred practice, to suppress the reduction in small dot recording rate mentioned earlier, the small dot dither matrix should be different from those for medium dots and large dots.

Until halftone module 99, which determines whether or not any dot should be formed in a single pixel by means of the processes described hereinabove, has completed processing for all pixels (Step S310), the processes of Steps S220–S300 are repeated. Once processing for all pixels has been completed, the halftone process routine is concluded for the time being, and returns to the dot formation control process routine.

In Step S400, print data generating module 100 performs generation of print data PD from halftone data generated in this manner. Print data PD is data that includes raster data indicating dot recording status during each main scan, and data indicating sub-scan feed distance, and is output to printer 20 (S410). Printer 20 receives this data and forms large, medium, and small dots on pixels to print an image. The aforementioned halftone process is performed on the assumption that there is no ink amount error contained in ink drops, so if error is included in ink amount, color will not be reproduced correctly.

C. Compensation of Ink Quantity in the First Embodiment

Figure 10:
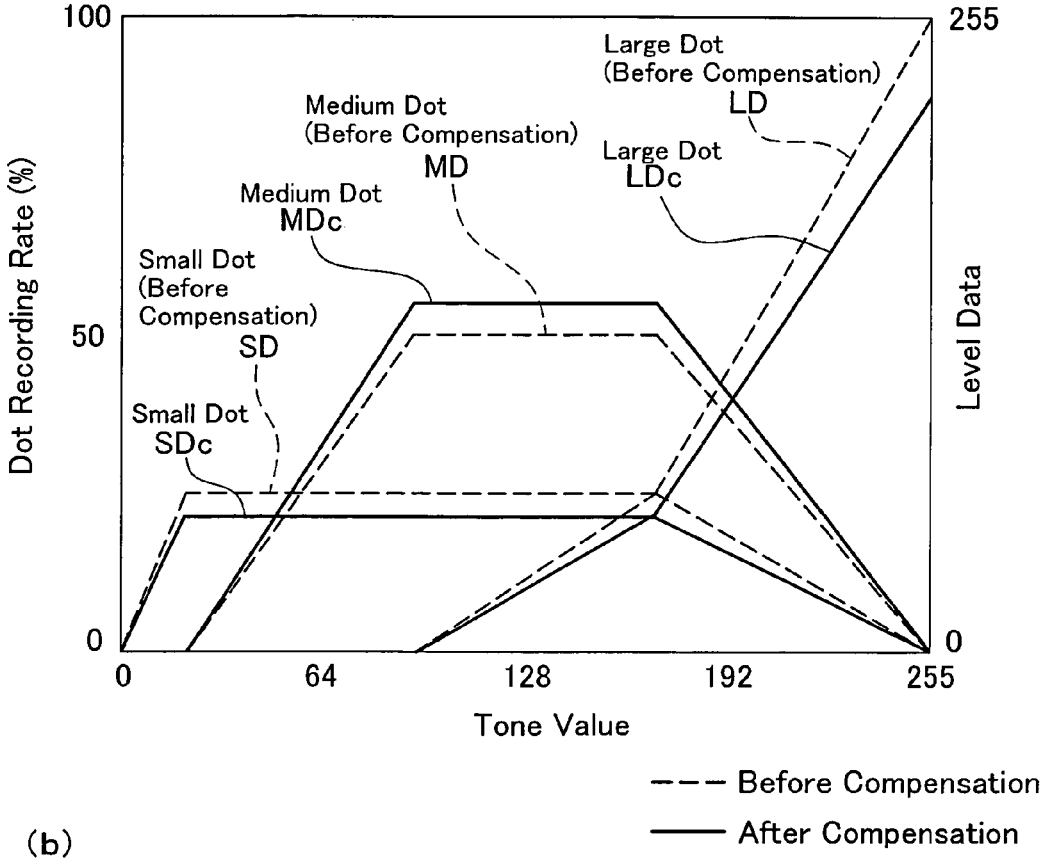
FIGS. 10(*a*) and 10(*b*) are explanatory diagrams showing a compensating method of a dot recording rate table performed in the first embodiment of the present invention.

FIG. 10 is an explanatory diagram showing a compensating method of a dot recording rate table performed in the first embodiment of the present invention. Curves SD, SDc in FIG. 10(*a*) show dot recording rate of small dots, and curves MD, MDc show dot recording rate of medium dots and curves LD, LDc of large dots, respectively. Dotted lines SD, MD, LD show dot recording rates prior to compensation, and solid lines SDc, MDc, LDc show dot recording rates after compensation. In this embodiment, by means of compensating the dot recording rate table, variation in ink amount due to individual error of print head unit 60 and so forth is compensated for each type of dot.

FIG. 10(*b*) shows target values of ink amount of ink drops for forming dots of each size, error information, estimated values of ink weight, compensation coefficients, and compensated ink amount. Target values of ink amount are ink weight of ink drops when it is assumed that ink drops are ejected without error. Error information is information representing error in ink weight of ink drops ejected by print head unit 60 used in printing. For example, in the case of an ink drop for forming a small dot, the target value for ink weight is 10 ng (nanograms), and the error information is 0.1. As a result, the ink weight of the ink drop ejected by print head unit 60 can be estimated to be 11 ng (=10 ng+10 ng×0.1). Compensation coefficients are determined such that multiplying by the estimated value of ink weight brings ink weight in approximation with the target value.

Compensation in the present embodiment is performed by adjusting the dot recording rate of dots of each size depending on the compensation coefficient. Specifically, it is performed by directly adjusting numbers of dots formed per unit of area. As shown in concrete terms in FIG. 10(*a*), in the case of small dots for example, curve SDc, which indicates the corrected dot recording rate, is generated by multiplying curve SD, which indicates the uncorrected dot recording rate, by a compensation coefficient of 0.91. Implementation of this adjustment may be carried out, for example, by including a process in which level data for dots of each size is multiplied by a corresponding compensation coefficient.

The printing process in this embodiment is carried out as follows. When application program 95 issues a print command, first, computer 88 reads out error information from the memory of print head unit 60 via control circuit 40 of printer 20. The error information is received by error information receiver 102 in computer 88, and sent to ink amount compensator 101. Ink amount compensator 101 calculates a compensation coefficient from the error information, and multiplies the compensation coefficient by the level data in the dot recording rate table DT provided to halftone module 99. In this way, dot recording rates for large, medium, and small dots are adjusted. When adjustment of dot recording rate is completed, printer driver 96 receives the image data from application program 95 in the manner described previously, and this is converted to print data PD for supply to color printer 20.

In this way, in the present embodiment, ink amount error can be compensated for each of several kinds of ink drops having different ink weights, so even in cases where there is deviation in error of ink amount among several kinds of ink drops, color can be reproduced accurately. By performing such compensation for each color of ink, accurate color balance can be achieved.

In the present embodiment, resolution conversion module 97, color conversion module 98, halftone module 99, and ink amount compensator 101 correspond to the dot data generator in the Claims.

D. Compensation of Ink Quantity in the Second Embodiment

In the second embodiment, a point of difference with the first embodiment, in which compensation is done by multiplying level data for dots of each size by compensation coefficients, is that compensation is done by adjusting tone values of multi-tone data.

Figure 11:
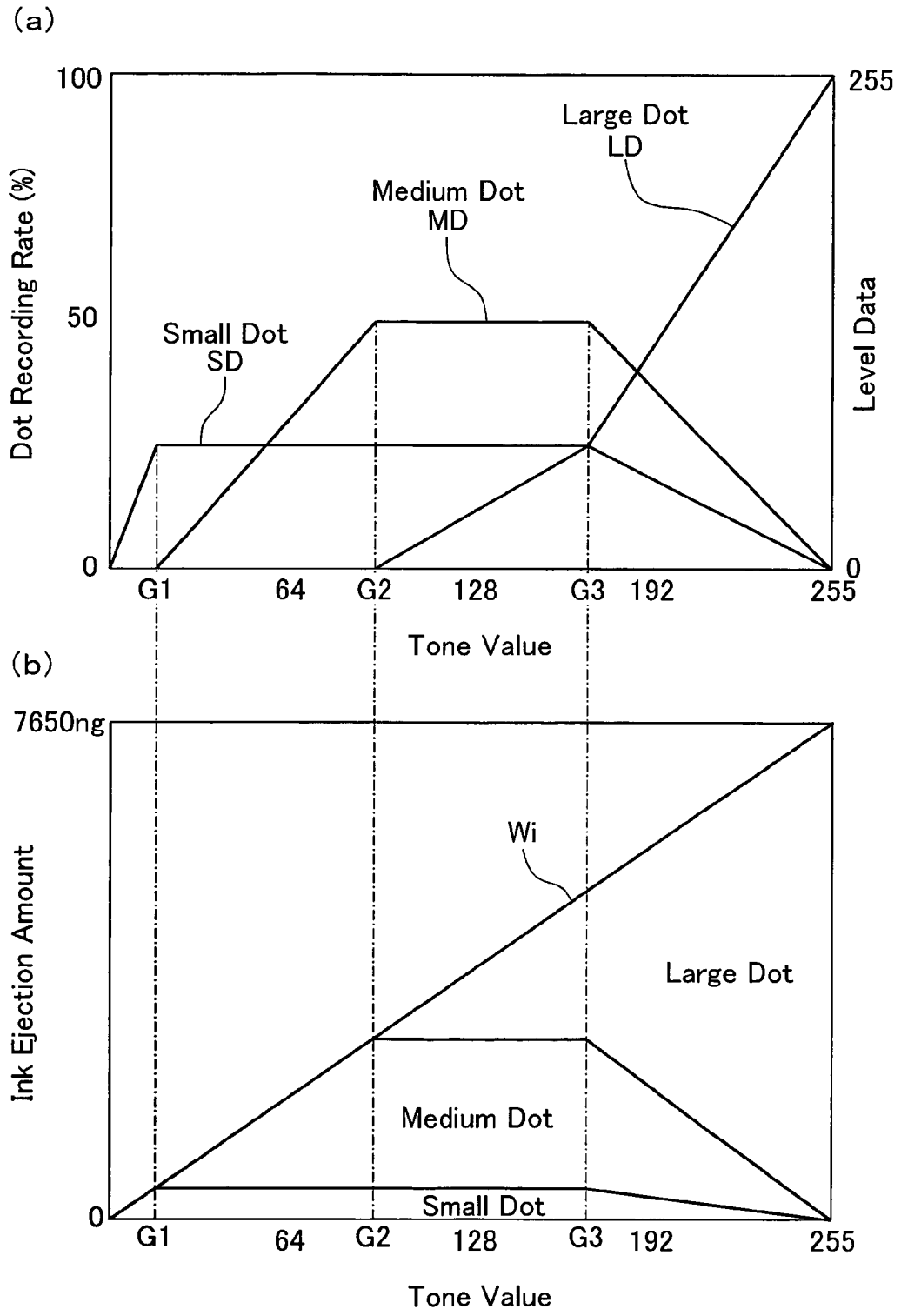
FIGS. 11(*a*) and 11(*b*) are explanatory diagrams showing a dot recording rate table and ink ejection amount in the second embodiment of the present invention.

FIG. 11 is an explanatory diagram showing a dot recording rate table and ink ejection amount in the second embodiment of the present invention. FIG. 11(*a*) is a diagram showing a relationship between multi-tone data tone values and dot recording rates for dots of each size; curves SD, MD, LD are the same as the dotted lines SD, MD, LD in FIG. 10(*a*). FIG. 11(*b*) is an explanatory diagram showing a relationship between tone values and ink weight ejected in a predetermined region. This diagram is a diagram generated using estimated values of ink drop weight from the chart in FIG. 10(*b*). As will be understood from this diagram, as tone value increases from 0 towards 255, ink ejection amount increases from 0 ng towards 7650 ng along a straight line Wi. In this way, in the present embodiment, tone values and ink weight ejected in a predetermined region have a linear relationship in order to facilitate understanding of the description.

As will be understood from FIGS. 11(*a*) (*b*), ink weight ejected in a predetermined region increases in the following manner with an increase in tone value.

(1) In a region of tone value 0 to tone value G1, ink weight increases in linear fashion with an increase in the dot recording rate of small dots.

(2) In a region of tone value G1 to tone value G2, dot recording rate of small dots is constant, and ink weight increases in linear fashion with an increase in the dot recording rate of medium dots.

(3) In a region of tone value G2 to tone value G3, dot recording rates of small dots and medium dots are constant, and ink weight increases in linear fashion with an increase in the dot recording rate of large dots.

(4) In a region of tone value G3 to maximum tone value, dot recording rates of small dots and medium dots shift into decline, and ink weight increases in linear fashion by means of substituting large dots for small dots and medium dots.

In the present embodiment, this profile is generated as a result of tradeoffs such as the following.

(1) In order to minimize graininess (deviation of image), it is preferable that the dot recording rate of relatively small dots be high. This characteristic is marked in low tone value regions.

(2) In order to reduce banding (band-like image degradation), it is preferable that the dot recording rate of relatively small dots be lowered by substituting relatively large dots for relatively small dots. This characteristic is marked in high tone value regions.

Thus, in the present embodiment, there is set a profile having an upper limit for dot recording rate of small dots of 25%, and an upper limit for dot recording rate of medium dots of 50%.

Figure 12:
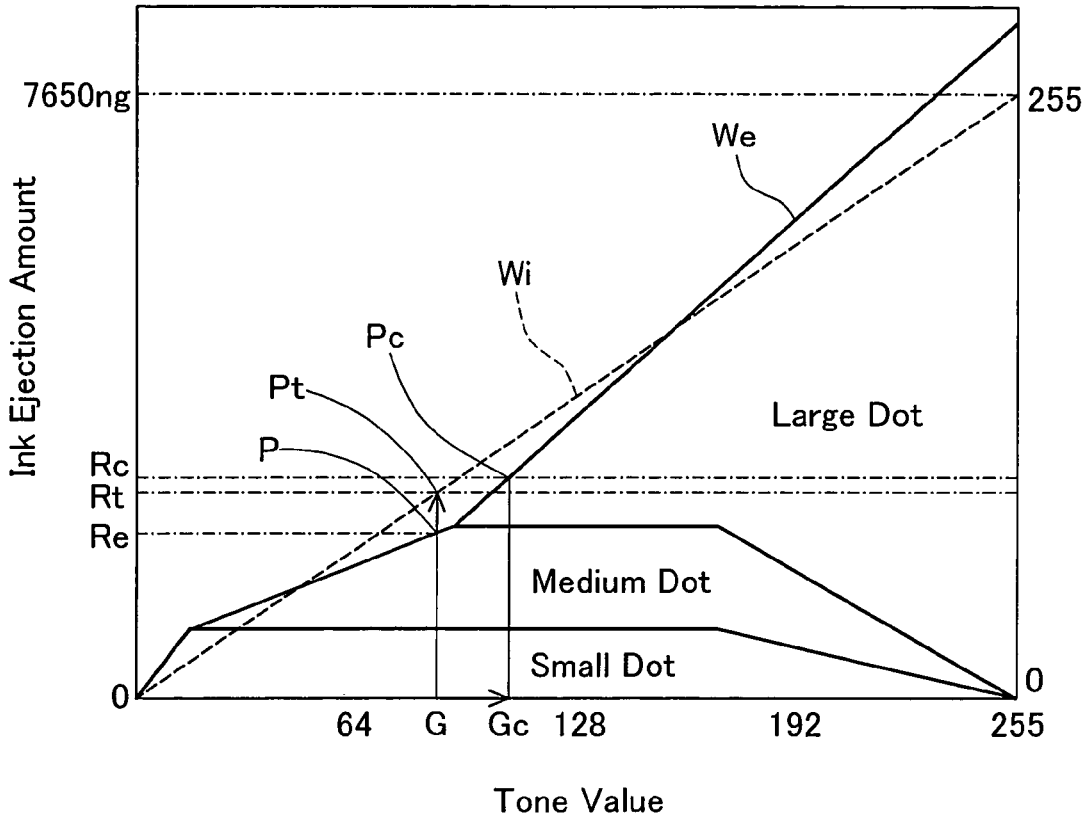
FIGS. 12(*a*) and 12(*b*) are explanatory diagrams showing a compensation method for error of ink amount in the second embodiment of the present invention.

FIG. 12 is an explanatory diagram showing a compensation method for error of ink amount in the second embodiment of the present invention. FIG. 12(*a*) is an explanatory diagram showing the condition of compensating for error of ink amount by means of adjusting tone value of multi-tone data. Dotted line Wi is a line showing a relationship between tone value assuming no error, and theoretical ink ejection amount, and is the same as straight line Wi in FIG. 11(*b*). Solid line We is a line showing a relationship between tone value in consideration of ink amount error, and estimated ink ejection amount. Solid line We is generated using estimated values for ink drop weight from the chart shown in FIG. 10(*b*), and is shifted away from dotted line Wi by the extent of ink amount error.

In the present embodiment, tone value of multi-tone data is adjusted in the following manner. For example, where tone value is G, the theoretical ink ejection amount assuming no ink amount error will be Rt on dotted line Wi, but since in actuality ink amount error is estimated, estimated ink ejection amount is Re. As a result, at tone value G, a difference between theoretical ink ejection amount Rt and estimated ink ejection amount Re can be predicted to occur. This difference is the ink amount error to be compensated.

FIG. 12(*b*) is an explanatory diagram showing a formula for adjusting tone value in order to compensate for error. In the present embodiment, theoretical ink ejection amount Rt is divided by estimated ink ejection amount Re, and the resultant value is multiplied by tone value G to calculate an adjusted tone value Gc. The ink ejection amount corresponding to tone value Gc calculated in this way is Rc. As will be understood from the diagram, the compensated ink ejection amount Rc more closely approximates the theoretical ink ejection amount Rt than does the estimated ink ejection amount Re, so it will be understood that ink amount error is held down. Theoretical ink ejection amount Rt corresponds to first ink amount in the Claims, and estimated ink ejection amount Re corresponds to second ink amount in the Claims.

Figure 13:
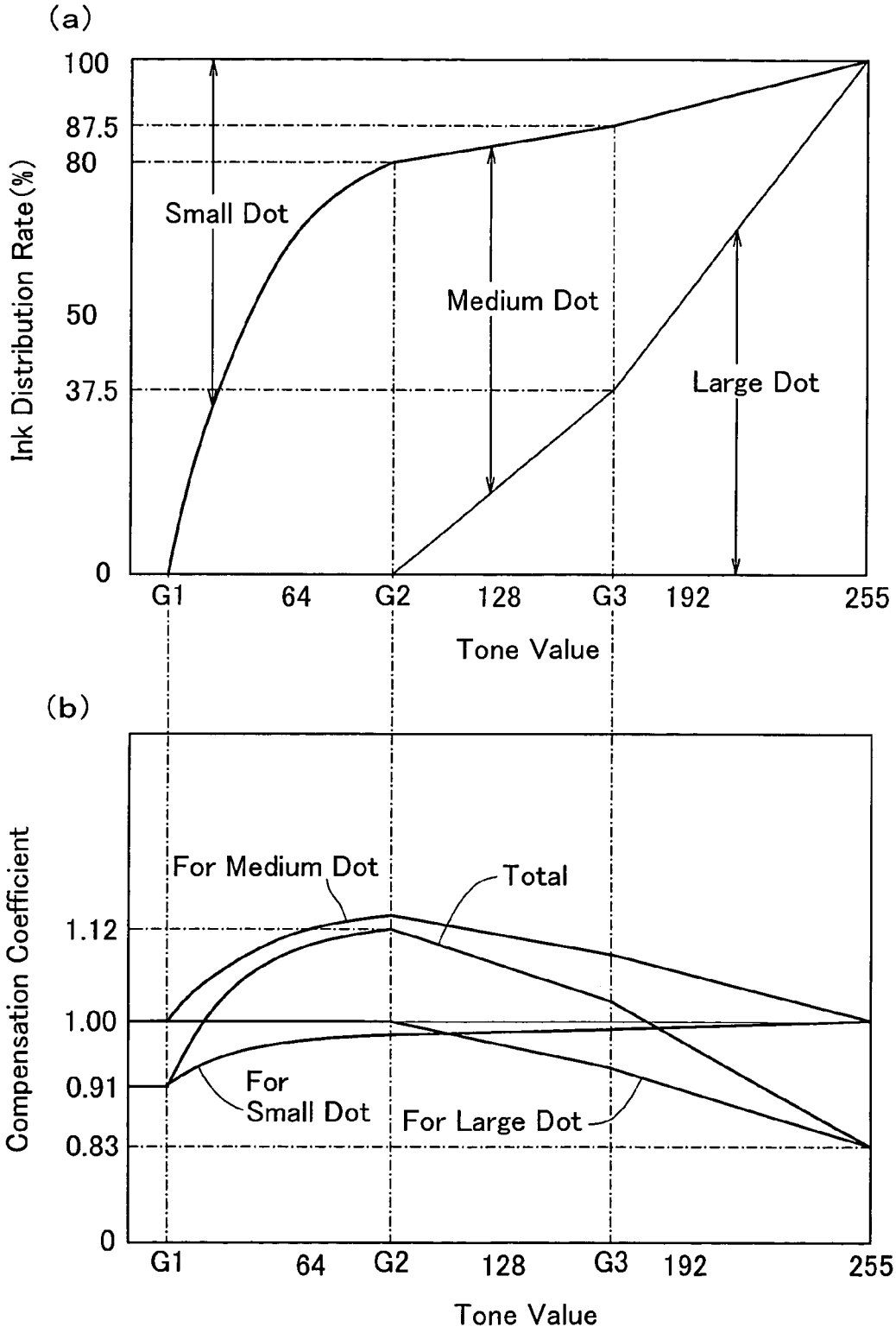
FIGS. 13(*a*) and 13(*b*) are explanatory diagrama showing a method of calculating a compensation coefficient for use in compensating ink amount error in the second embodiment of the present invention.

FIG. 13 is an explanatory diagram showing a method of calculating a compensation coefficient (Rt/Re) for use in compensating ink amount error in the second embodiment of the present invention. FIG. 13(*a*) is an explanatory diagram showing a relationship of tone value and distribution of ink amount in order to form dots of each size. This diagram shows percentages of ink amount ejected in a predetermined region, for dots of each size. For example, where tone value is G1, only ink drops for forming small dots are ejected, so the distribution of small dots is 100%, and the distributions of medium dots and large dots are each 0%. Where tone value is G2, distributions of large dots, medium dots, and small dots are 0%, 80%, and 20%, respectively. Where tone value is G3, distributions of large dots, medium dots, and small dots are 37.5%, 50% (=87.5%−37.5%), and 12.5%, respectively.

This distribution can be calculated by the method indicated hereinbelow, on the basis of theoretical ink ejection amount. Specifically, distributions of dots of each size can be calculated from the product of the weight of each ink drop (for example, 10 ng in the case of a small dot) and the dot recording rate. For example, where tone value is G2, the product of ink drop weight and dot recording rate for small dots is 10 ng×25%, and for medium dots is 20 ng×50%. On the other hand, the dot recording rate for large dots is 0%, so the ratio of ink amount for small, medium, and large dots is 250:1000:0. From this result, an ink amount distribution of 20% (=250÷(250+1000)) for small dots and 80% for medium dots can be calculated. Using this distribution, a compensation coefficient for adjusting tone value can be calculated by the method indicated hereinbelow.

FIG. 13(*b*) is an explanatory diagram showing a relationship between tone value and compensation coefficient for adjusting tone value. This compensation coefficient can be calculated from ink amount distribution and compensation coefficient for dots of each size shown in FIG. 10(*b*). Specifically, products of ink amount distribution and compensation coefficient are calculated for dots of each size, and the sum of these values is then calculated.

For example, where tone value is G1, ink amount distribution for small dots is 100%, so the compensation coefficient is the same as the compensation coefficient for small dots, i.e., 0.91. Where tone value is G2, the compensation coefficient for small dots is 0.18, which is the product of the ink amount distribution for small dots, i.e. 20%, and the coefficient for small dots, i.e., 0.91; and the compensation coefficient for medium dots is 0.94, which is the product of the ink amount distribution for medium dots, i.e. 80%, and the coefficient for medium dots, i.e., 1.18. As a result, the compensation coefficient is 1.12. Adjustment of tone value is performed using this value. For example, assuming that the tone value of G2 is 100, the tone value will be substituted by the product of this compensation coefficient. i.e., 112. By generating level data with this substituted tone value as the input value, ink amount error can be compensated.

In this way, in the present embodiment, compensation can be done by adjusting tone value, so the combination of dot recording rates for each size of dot does not change per se. As a result, there is the advantage that even where a combination of dot recording rates has been set so as to minimize graininess (deviation of image) and banding (band-like image degradation), the features of the combination of dot recording rates will not be excessively diminished, and color can be reproduced more accurately.

E. Compensation of Ink Quantity in the Third Embodiment

The third embodiment has in common with the second embodiment the point that ink amount can be compensated by adjusting tone value, without changing the combination of dot recording rates for each size of dot per se. However, the method for adjusting tone value in this embodiment is different from the second embodiment.

Figure 14:
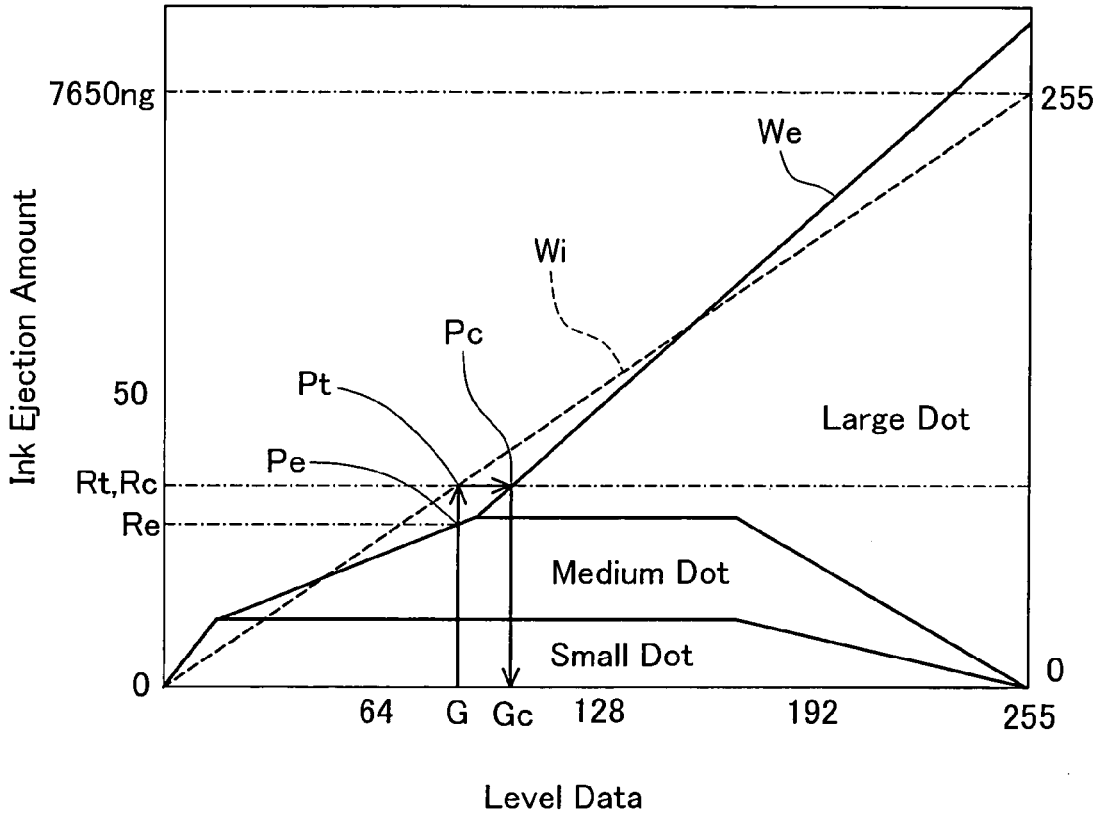
FIG. 14 is an explanatory diagram showing a compensation method for error of ink amount in the third embodiment of the present invention.

FIG. 14 is an explanatory diagram showing a compensation method for error of ink amount in the third embodiment of the present invention. Dotted line Wi is a line showing a relationship between tone value and theoretical ink ejection amount, and solid line We is a line showing a relationship between tone value and estimated ink ejection amount. Solid line We and dotted line Wi are respectively the same as solid line We and dotted line Wi shown in FIG. 12(*a*).

In the present embodiment, tone value is adjusted in the following manner. For example, where the inputted input tone value is G, the theoretical ink ejection amount will be Rt, corresponding to point Pt on dotted line Wi. Point Pc is determined by searching on solid line We for the tone value capable of ejecting the ink amount closest to this ink ejection amount Rt. The tone value Gc corresponding to this point Pc is the adjusted output tone value. In this way, an input tone value G is converted to an output tone value Gc.

FIG. 15 is an explanatory diagram showing dot recording rate table DT and ink ejection amount in the third embodiment of the present invention. FIG. 15(*a*) is a table generated using target values of ink amount. For example, when input tone value is 106, 64 small dots are formed, 128 medium dots are formed, and no large dots are formed. Meanwhile, the target value of ink drop weight is 10 ng for a small dot, and 20 ng for a medium dot. As a result, as shown in the drawing, it will be understood that it is assumed in the halftone process that 640 ng of ink is ejected to form the small dots, and 2560 ng of ink to form the medium dots, for a total of 3200 ng of ink.

FIG. 15(*b*) is a dot recording rate table DT generated using estimated values for ink amount. From error information it is understood that ink drop weight is 11 ng for a small dot and 17 ng for a medium dot. As a result, if tone value is not adjusted, it is estimated that 704 ng (=11 ng×64) of ink is ejected to form small dots and 2176 ng (=17 ng×128) to form medium dots, for a total of 2880 ng of ink. It will be understood that since this value is smaller than ink amount desirable for accurate color reproduction, unless compensated, color of lower tone value than the color desired to be reproduced will be reproduced.

FIG. 16 is a correspondence chart used for adjusting tone value in the third embodiment. This correspondence chart is a chart for adjusting tone value to bring ink amount estimated to be ejected into approximation with ink amount desired to be ejected. For example, when input tone value—which is the tone value that should be represented—is 106, the corresponding output tone value will be 115. It will be understood that as a result, the ink amount estimated to be ejected is modified from 2880 ng to 3204 ng, which approximates 3200 ng, the ink amount desired to be ejected.

In this way, the present embodiment is similar to the second embodiment described hereinabove in respect of the point of compensating by adjusting tone value, but permits input tone values to be associated arbitrarily with output tone values, which has the advantage that error in ink ejection amount can be minimized.

F. Variations

This invention is not limited to the examples and embodiments described hereinabove, and can be worked in various modes without departing from the spirit thereof; for example, variations such as the following are possible as well.

F-1. In the examples hereinabove, compensation is performed for all individual ink drops for forming large dots, medium dots, and small dots, but compensation could be performed for some types of ink drops. For example, compensation could be performed for a specific type of ink drop (for example, small ink drops) only, with compensation not performed for other types of ink drops.

By so doing, in instances where it is known in advance that error is great for small ink drops only, a simple arrangement such that only small ink drops are compensated will be possible. Also, a type of ink drop having large error may be selected with reference to error information, and compensation performed only for the type of ink drop having large error, so that the compensation process is accelerated.

F-2. In Examples 2 and 3 hereinabove, compensation of ink amount is performed by means of adjusting tone value of dot recording rate table DT, but could be performed by adjusting tone value of color conversion table LUT. Also, a color conversion table LUT of adjusted tone values could be generated, and color conversion performed using this in order to perform compensation. A color conversion table LUT of adjusted tone values corresponds to corrected color conversion table in the Claims.

Color conversion table LUT may be generated in memory at the time of printer selection or when the printer driver is run, or may be generated when the printer driver is installed or when the print head unit is replaced, and stored in the computer's hard disk. The former has the advantage that where it is possible to utilize a plurality of printers, confusion regarding printer-color conversion table associations may be avoided, whereas the latter has the advantage that the time required for printer selection and printer driver running can be reduced.

F-3. In the preceding examples, ink amount error is compensated in the halftone process, but could be compensated in the color conversion process for example, or compensated by means of adjusting tone values of original image data prior to color conversion. In general, compensation of ink amount performed in the present invention can be performed in any process in which supplied original image data is processed into dot data.

F-4. In the preceding examples, a method of a dither diffusion process is used in the halftone process, but an error diffusion method could also be used. In general, the method of the halftone process can be any one that can reduce multilevel data of each ink color to a number of tone values possible to form by means of N types of dots.

F5. In the preceding examples a printer equipped with a head that uses piezo elements to eject ink is used, but a printer that ejects ink by another method could be used. For example, it is applicable to a printer of a type wherein current is passed through a heater arranged on the ink passage, and ink is ejected by means of bubbles generated within the ink passage.

Processes in the printing device described hereinabove can be realized by means of a computer program. As storage media having such a computer program recorded thereon, there may be employed flexible disks, CD-ROM, magneto-optical disks, IC cards, ROM cartridges, punch cards, printed matter imprinted with bar codes or other symbols, computer internal memory devices (RAM, ROM, and other memory) and external memory devices, and other such computer-readable media. The form of a program supplying device that supplies computer program for performing image processing and the like described hereinabove on a computer via a communications path is also possible.

INDUSTRIAL APPLICABILITY

This invention is applicable to computer output devices.

What is claimed is:

1. A printing control apparatus for generating print data to be supplied to a print unit capable of forming one of N types of dots having different sizes at one pixel area by a selective ejection of any of the N types of ink drops onto a print medium, the N types of ink drops being different in an ink amount, N being an integer of at least 2, the apparatus comprising:

an error information receiver configured to receive error information related to an ink amount error of at least one specific type of ink drop among the N types of ink drops, the error information being provided from the print unit; and a dot data generator configured to process input image data for generating dot data representing a state of dot formation at each pixel in a printed image;

wherein the dot data generator is configured to generate the dot data compensated for the ink amount error with respect to each of the specific type of ink drops in response to the error information.

2. The printing control apparatus in accordance with claim 1, wherein the dot data generator comprises:

a color converter configured to convert a color system of the input image data with a color conversion table for generating color-converted image data, the color-converted image data being represented with a plurality of color components available for the print unit; and a halftone processor configured to convert a tone value of the color-converted image data to any of the N tones with respect to each pixel based on a compensated relationship between an input and an output, the input being the tone value of the color-converted image data, the output being a combination of dot recording rates for each of the N dots, the compensated relationship being compensated with the error information; wherein the halftone processor is configured to generate the compensated relationship using a reference relationship and the error information, the reference relationship being a relationship between the combination of dot recording rates for each of the N dots and a provided tone value of the color-converted image data assuming no ink amount error.

3. The printing control apparatus in accordance with claim 2, wherein the halftone processor is configured to calculate a first ink amount and a second ink amount with respect to each of the tone values of the color-converted image data based on the reference relationship, and also to multiply a value of the first ink amount divided by the second ink amount for generating the compensated relationship, the first ink amount being an ink amount ejected per unit of area excluding the ink amount error, the second ink amount being an ink amount ejected per unit of area including the ink amount error.

4. The printing control apparatus in accordance with claim 2, wherein the halftone processor is configured to calculate a first ink amount with respect to each of the tone values of the color-converted image data based on the reference relationship, and also to adjust the reference relationship for a second ink amount to approximate to the first ink amount, the first ink amount being an ink amount ejected per unit of area excluding the ink amount error, the second ink amount being an ink amount ejected per unit of area including the ink amount error.

5. The printing control apparatus in accordance with claim 1, wherein the dot data generator comprises:

a color converter configured to convert a color system of the input image data with a compensated color conversion table for generating color-converted image data, the color-converted image data being represented with a plurality of color components available for the print unit, the compensated color conversion table being compensated with the error information; and a halftone processor configured to convert a tone value of the color-converted image data to any of the N tones with respect to each pixel based on a relationship between an input and an output, the input being the tone value of the color-converted image data, the output being a combination of dot recording rates for each of the N dots; wherein the color converter is configured to generate the compensated color conversion table using a reference color conversion table and the error information, the reference color conversion table being set assuming no ink amount error.

6. A printing control method of generating print data to be supplied to a print unit capable of forming one of N types of dots having different sizes at one pixel area by a selective ejection of any of the N types of ink drops onto a print medium, the N types of ink drops being different in an ink amount, N being an integer of at least 2, the method comprising:

(a) receiving error information related to an ink amount error of at least one specific type of ink drop among the N types of ink drops, the error information being provided from the print unit; and (b) processing input image data for generating dot data representing a state of dot formation at each pixel in a printed image;

wherein the step (b) includes the step of compensating the dot data for the ink amount error with respect to each of the specific types of ink drops in response to the error information.

7. A printing method of forming one of N types of dots having different sizes at one pixel area by a selective ejection of any of the N types of ink drops onto a print medium, the N types of ink drops being different in an ink amount, N being an integer of at least 2, the method comprising:

(a) receiving error information related to an ink amount error of at least one specific type of ink drop among the N types of ink drops, the error information being provided from a print unit;

(b) processing input image data for generating dot data representing a state of dot formation at each pixel in a printed image; and (c) ejecting the N types of ink drops onto the print medium in response to the dot data;

wherein the step (b) includes the step of compensating the dot data for the ink amount error with respect to each of the specific types of ink drops in response to the error information.

8. A computer-readable recording medium, storing a computer program for causing a computer to generate print data to be supplied to a print unit capable of forming one of N types of dots having different sizes at one pixel area by a selective ejection of any of the N types of ink drops onto a print medium, the N types of ink drops being different in an ink amount, N being an integer of at least 2, the computer program comprising programs for causing the computer to perform:

a receiving function for receiving error information related to an ink amount error of at least one specific type of ink drop among the N types of ink drops, the error information being provided from the print unit; and a generating function for processing input image data for generating the dot data representing a state of dot formation at each pixel in a printed image;

wherein the generating function includes a function for compensating the dot data for the ink amount error with respect to each of the specific types of ink drops in response to the error information.

* * * * *